US008991375B2

(12) United States Patent
McPherson

(10) Patent No.: US 8,991,375 B2
(45) Date of Patent: Mar. 31, 2015

(54) CROSSBOW CABLING ARRANGEMENT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 3 days.

(21) Appl. No.: 13/835,783

(22) Filed: Mar. 15, 2013

(65) Prior Publication Data

US 2014/0261357 A1 Sep. 18, 2014

(51) Int. Cl.
*F41B 5/12* (2006.01)
*F41B 5/14* (2006.01)

(52) U.S. Cl.
CPC . *F41B 5/123* (2013.01); *F41B 5/14* (2013.01); *F41B 5/12* (2013.01)
USPC ..... 124/25; 124/24.1; 124/25.6; 124/86; 124/88

(58) Field of Classification Search
CPC ..... F41B 5/123; F41B 5/12; F41B 5/14
USPC ..... 124/24.1, 25, 25.6, 86, 88
See application file for complete search history.

(56) References Cited

U.S. PATENT DOCUMENTS

| | | | | |
|---|---|---|---|---|
| 577,641 | A | 2/1897 | Bruder | |
| 2,500,509 | A * | 3/1950 | Bailey | 124/25 |
| 2,609,810 | A | 9/1952 | Gruner | |
| D283,637 | S | 4/1986 | Williams | |
| 4,587,944 | A | 5/1986 | Barnett | |
| 4,649,891 | A * | 3/1987 | Bozek | 124/25 |
| 4,693,228 | A * | 9/1987 | Simonds et al. | 124/25 |
| 4,722,318 | A * | 2/1988 | Yankey | 124/25 |
| H000486 | H | 7/1988 | Savioli | |
| 4,766,874 | A * | 8/1988 | Nishioka | 124/25 |
| 4,860,719 | A * | 8/1989 | Scheiterlein | 124/25 |
| 4,879,987 | A * | 11/1989 | Nishioka | 124/25 |
| 4,917,071 | A * | 4/1990 | Bozek | 124/25 |
| 5,119,797 | A * | 6/1992 | Anderson | 124/25 |
| 5,630,405 | A * | 5/1997 | Nizov | 124/25 |
| 5,678,528 | A * | 10/1997 | Hadley | 124/25 |
| 5,823,172 | A * | 10/1998 | Suggitt | 124/25 |
| 6,267,108 | B1 * | 7/2001 | McPherson et al. | 124/25 |
| 6,560,911 | B2 | 5/2003 | Sharp | |
| 6,651,641 | B1 * | 11/2003 | Bower et al. | 124/25 |
| 6,715,481 | B1 * | 4/2004 | Anderson | 124/88 |
| 6,990,970 | B1 * | 1/2006 | Darlington | 124/25.6 |
| 7,174,884 | B2 * | 2/2007 | Kempf et al. | 124/25 |
| 7,328,693 | B2 * | 2/2008 | Kempf | 124/25 |
| 7,363,921 | B2 * | 4/2008 | Kempf | 124/25 |
| 7,441,555 | B1 * | 10/2008 | Larson | 124/25.6 |
| 7,708,001 | B2 | 5/2010 | Kempf | |
| 7,823,572 | B2 * | 11/2010 | Anderson | 124/25 |
| 7,832,386 | B2 * | 11/2010 | Bednar et al. | 124/25 |
| 7,836,871 | B2 * | 11/2010 | Kempf | 124/25 |
| 7,891,348 | B2 * | 2/2011 | Colley | 124/25 |

(Continued)

*Primary Examiner* — Melba Bumgarner
*Assistant Examiner* — Alexander Niconovich
(74) *Attorney, Agent, or Firm* — Vidas, Arrett & Steinkraus

(57) ABSTRACT

In at least one embodiment, a crossbow comprises a stock, a first limb, a first rotatable member, a second limb and a second rotatable member. A bowstring, a first cable and a second cable each extend between the first rotatable member and the second rotatable member. The crossbow defines a shooting axis. The first cable is offset from the shooting axis in a first direction and the second cable is offset from the shooting axis in a second direction different from the first direction.

20 Claims, 10 Drawing Sheets

(56) References Cited

U.S. PATENT DOCUMENTS

| | | | | |
|---|---|---|---|---|
| 7,930,849 | B2 | 4/2011 | Abraham et al. | |
| 7,938,108 | B2 * | 5/2011 | Popov et al. | 124/25 |
| 8,225,777 | B2 * | 7/2012 | Chu | 124/25 |
| 8,387,603 | B2 * | 3/2013 | Darlington | 124/25.6 |
| 8,522,762 | B2 * | 9/2013 | Trpkovski | 124/25.6 |
| 8,567,376 | B2 * | 10/2013 | Flint | 124/20.3 |
| 8,627,811 | B1 * | 1/2014 | Darlington | 124/25 |
| 8,651,095 | B2 * | 2/2014 | Islas | 124/25 |
| 8,656,899 | B2 * | 2/2014 | Bednar et al. | 124/25 |
| 8,671,923 | B2 * | 3/2014 | Goff et al. | 124/25 |
| 8,701,642 | B2 * | 4/2014 | Biafore et al. | 124/25 |
| 2002/0020403 | A1 | 2/2002 | Troubridge | |
| 2005/0279338 | A1 * | 12/2005 | Dziekan | 124/25 |
| 2007/0101631 | A1 | 5/2007 | Bentley | |
| 2007/0289190 | A1 | 12/2007 | Oz | |
| 2008/0168969 | A1 | 7/2008 | Kempf | |
| 2009/0101126 | A1 * | 4/2009 | Anderson | 124/25 |
| 2009/0194086 | A1 | 8/2009 | Kempf | |
| 2010/0116259 | A1 * | 5/2010 | Popov et al. | 124/25 |
| 2010/0170488 | A1 * | 7/2010 | Rasor et al. | 124/25 |
| 2010/0186728 | A1 | 7/2010 | Bednar et al. | |
| 2010/0206284 | A1 * | 8/2010 | Popov et al. | 124/88 |
| 2010/0269807 | A1 | 10/2010 | Kempf | |
| 2011/0016764 | A1 | 1/2011 | Cales | |
| 2011/0030666 | A1 * | 2/2011 | Darlington | 124/25 |
| 2011/0041820 | A1 * | 2/2011 | Stanziale | 124/25 |
| 2011/0203561 | A1 | 8/2011 | Shaffer et al. | |
| 2011/0232619 | A1 | 9/2011 | Bednar et al. | |
| 2011/0308508 | A1 * | 12/2011 | Islas | 124/25 |
| 2012/0006311 | A1 * | 1/2012 | Bednar et al. | 124/25 |
| 2012/0125302 | A1 * | 5/2012 | Stanziale | 124/25 |
| 2012/0298087 | A1 * | 11/2012 | Trpkovski | 124/25 |
| 2014/0069402 | A1 * | 3/2014 | McPherson | 124/25 |

* cited by examiner

CROSSBOW CABLING ARRANGEMENT

BACKGROUND OF THE INVENTION

This invention relates generally to crossbows and more particularly to a cabling arrangement that provides for more balanced forces.

Crossbows are generally known in the art. Crossbows typically include a bow assembly portion mounted on a stock portion, which typically includes a string latch and trigger assembly for holding a drawn crossbow string and selectively releasing it.

When a bow portion comprises a compound bow, often multiple cables are held away from the shooting axis by a portion of the stock. There remains a need for cabling arrangements that provide for a more balanced crossbow system.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a crossbow comprises a stock, a first limb, a first rotatable member, a second limb and a second rotatable member. A bowstring and a first cable each extend between the first rotatable member and the second rotatable member. The crossbow defines a shooting axis, and the stock extends below the shooting axis. The first cable is positioned above the shooting axis. In some embodiments, a crossbow comprises a cable positioner arranged to position the first cable. In some embodiments, the cable positioner comprises a roller.

In at least one embodiment, a crossbow comprises a stock, a first limb, a first rotatable member, a second limb and a second rotatable member. A bowstring, a first cable and a second cable each extend between the first rotatable member and the second rotatable member. The crossbow defines a shooting axis. The first cable is offset from the shooting axis in a first direction and the second cable is offset from the shooting axis in a second direction different from the first direction.

In some embodiments, the first cable is positioned above the shooting axis and the second cable is positioned below the shooting axis.

In some embodiments, a crossbow comprises a stock, a first limb, a first rotatable member, a second limb and a second rotatable member. A bowstring, a first cable and a second cable each extend between the first rotatable member and the second rotatable member. The crossbow defines a shooting axis. A cable guard comprises a first cable positioner and a second cable positioner. The first cable positioner is arranged to hold the first cable above the shooting axis, and the second cable positioner is arranged to hold the second cable below the shooting axis.

These and other embodiments which characterize the invention are pointed out with particularity in the claims annexed hereto and forming a part hereof However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
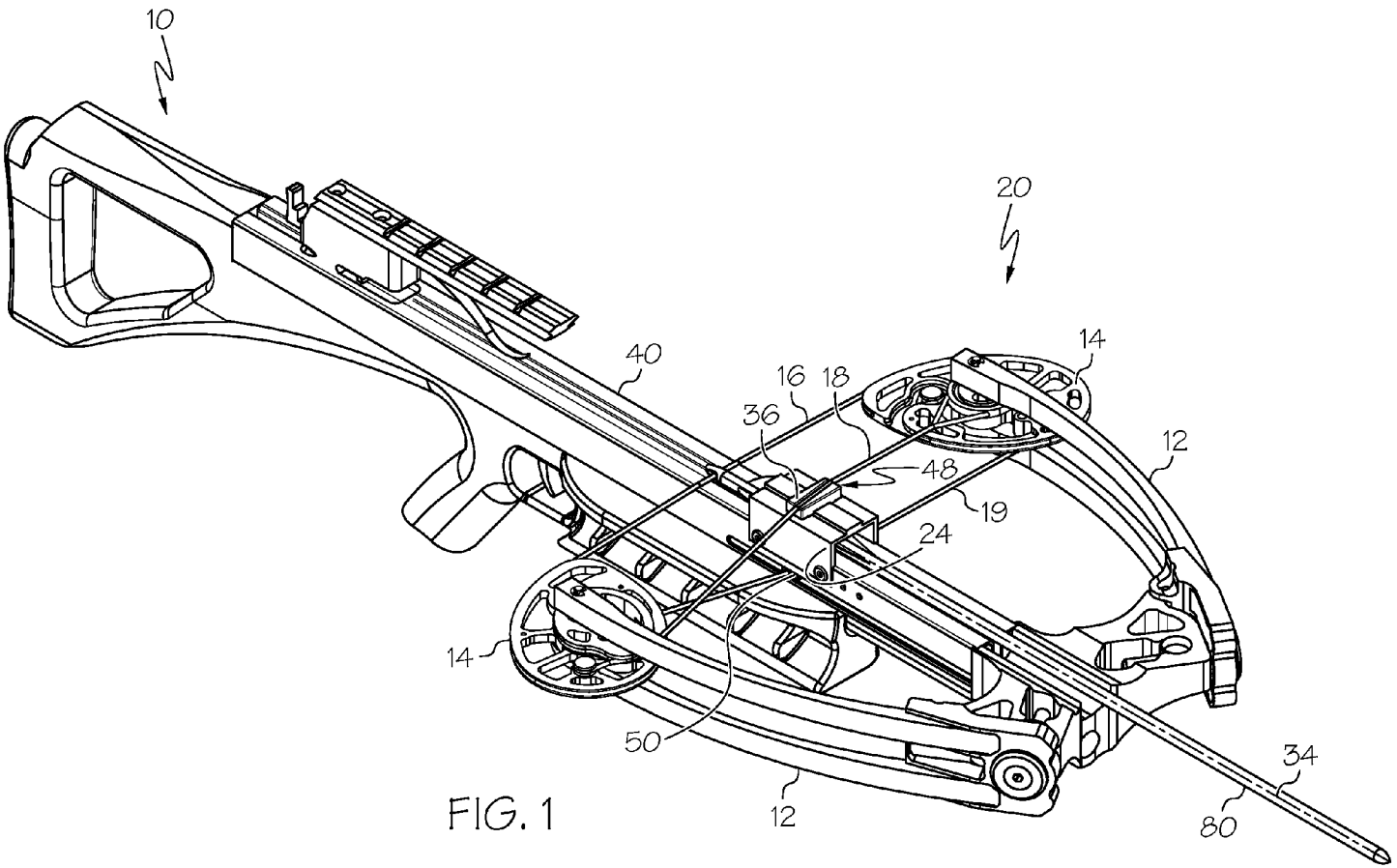
FIG. 1 shows an embodiment of a crossbow in a brace orientation.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10 in an undrawn or brace condition. In some embodiments, a crossbow 10 comprises a compound bow portion 20 and a stock portion 40. The bow portion 20 comprises limbs 12, rotatable members 14 and a bowstring 16. The bow portion 20 further comprises a first cable 18 and a second cable 19 that extend between the rotatable members 14. As the crossbow 10 is drawn, the limbs 12 flex and change shape, resulting in movement of the cables 18, 19.

In some embodiments, the bow portion 20 comprises a dual cam bow wherein both rotatable members 14 comprise cams, and cables 18, 19 each comprise a power cable. In some embodiments, the rotatable members 14 and cables 20 are mirrored across a shooting axis 34, desirably providing a system that is substantially laterally balanced.

An arrow or bolt 80 desirably travels along the shooting axis 34 when launched. In some embodiments, the stock 40 extends below said shooting axis 34.

Desirably, the cables 18, 19 are held away from the shooting axis 34, which allows clearance for a bolt 80. Desirably, the first cable 18 is positioned away from the shooting axis 34 in a first direction, and the second cable is positioned away from the shooting axis 34 in a second direction that is different from the first direction. In some embodiments, the first direction is opposite the second direction. In some embodiments, the first cable 18 is positioned above the shooting axis 34 and the second cable is positioned below the shooting axis 34. This arrangement helps to balance forces in the crossbow 10, for example reducing rotatable member 14 lean when compared to a crossbow that routes multiple cables on a common side of the shooting axis 34.

In some embodiments, the crossbow 10 comprises a first cable positioner 48 arranged to position the first cable 18. In some embodiments, the crossbow 10 comprises a second cable positioner 50 arranged to position the second cable 19.

Figure 2:
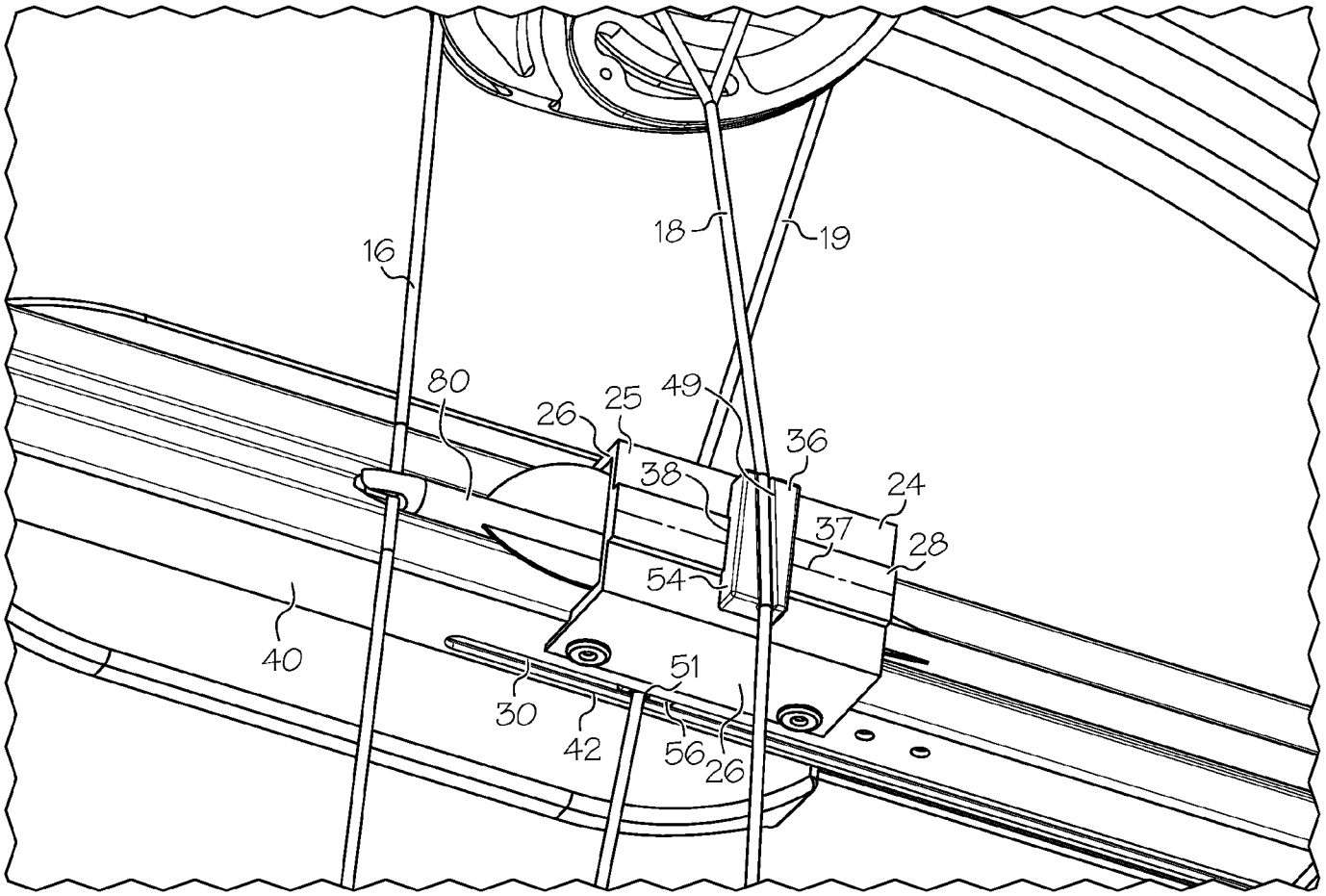
FIG. 2 shows a portion of a crossbow in greater detail.

FIG. 2 shows embodiments of a first cable positioner 48 and a second cable positioner 50 in greater detail.

In some embodiments, the first cable positioner 48 comprises a body 24 that is arranged to position the first cable 18 away from the shooting axis 34. As shown in FIG. 2, the body 24 is attached to the stock 40. In some embodiments, the body 24 can be formed integrally with the stock. In some embodiments, the body 24 comprises opposed sidewalls 26 and a top 25. In some embodiments, the body defines a tunnel through which a bolt 80 passes during launch. Desirably, the tunnel is sized to accommodate vanes or fletching of the bolt 80.

In some embodiments, the first cable positioner 48 comprises a recess or channel 49, and the first cable 18 is positioned in the channel 49. In some embodiments, the channel 49 is formed in the body 24. A channel 49 can have any suitable orientation and is desirably oriented to match the first cable 18. For example, the first cable 18 will generally cross the shooting axis 34 at a non-zero angle (e.g. when viewed from above). In some embodiments, a longitudinal axis of the channel 49 is oriented at an angle to the shooting axis 34, similar to an angle of the first cable 18. It should be noted that the crossing angle of the first cable 18 can be different in the brace and drawn conditions. In some embodiments, a longitudinal axis of the channel 49 is oriented to match the crossing angle of the first cable 18 in the brace condition. In some embodiments, a longitudinal axis of the channel 49 is oriented to match the crossing angle of the first cable 18 in the drawn condition. In some embodiments, a longitudinal axis of the channel 49 is oriented to match an average crossing angle of the first cable 18 in the brace and drawn conditions. In some embodiments, a width of the channel 49 increases at the ends to allow for a change in the crossing angle of the first cable 18.

In some embodiments, a depth of the channel 49 increases at the ends of the channel 49. In some embodiments, a surface of the channel 49 that contacts the first cable 18 (e.g. a bottom surface as shown in FIG. 2) is curved, which helps to distribute the lateral forces applied between the first cable 18 and the channel 49.

In some embodiments, the first cable positioner 48 comprises a guide member 36 arranged to guide and/or be moved by the first cable 18. In some embodiments, the guide member 36 comprises the channel 49. Desirably, the guide member 36 is moveable with respect to the body 24. In some embodiments, the guide member 36 is arranged to traverse along a linear axis 37 with respect to the body 24. In some embodiments, the axis 37 is parallel to the shooting axis 34. In some embodiments, the axis 37 is orthogonal to a longitudinal axis of the channel 49. In some embodiments, the body 24 and the guide member 36 comprise complimentary engagement features that prevent movement in at least one direction. In some embodiments, a guide member 36 comprises one or more flange portions 54 arranged to abut a portion of the body 24. In some embodiments, a flange portion 54 is provided on each side of the guide member 36, and the flanges 54 straddle the body 24. As shown in FIG. 2, the body 24 comprises a ridge 28 and the guide member 36 comprises a groove 38 that receives the ridge 28. The guide member 36 can traverse along the ridge 28 with respect to the body 24. In some embodiments, forces applied to the guide member 36 by the first cable 18 hold the guide member 36 against the body 24.

In some embodiments, the complimentary engagement features of the guide member 36 and the body 24 prevent movement in at least two orthogonal directions. For example, in some embodiments (not shown), a ridge 28 comprises a T-shaped cross-section, and the groove 38 comprises a complimentary T-shape.

In some embodiments, a second cable positioner 50 comprises a body 30 that is arranged to position the second cable 19 away from the shooting axis 34. As shown in FIG. 2, the body 30 comprises a portion of the stock 40. In some embodiments, the body 30 comprises a slot or aperture 42 in the body 30. Thus, in some embodiments, the second cable 19 passes through an aperture 42 in the stock 40, and the stock 40/body 30 holds the second cable 19 away from the shooting axis 34. Desirably, the aperture 42 is of a suitable size to allow for the movement of the second cable 19.

In some embodiments, the body 30 can comprise a separate member that is attached to the stock 40.

In some embodiments, the second cable positioner 48 comprises a recess or channel 51, and the second cable 19 is positioned in the channel 51. In some embodiments, the channel 51 is formed in the body 30. A channel 51 can have any suitable orientation and is desirably oriented to match the second cable 19. For example, the second cable 19 will generally cross the shooting axis 34 at a non-zero angle (e.g. when viewed from above). In some embodiments, a longitudinal axis of the channel 51 is oriented at an angle to the shooting axis 34, similar to an angle of the second cable 19.

In some embodiments, a longitudinal axis of the channel 51 is oriented to match the crossing angle of the second cable 19 in the brace condition. In some embodiments, a longitudinal axis of the channel 51 is oriented to match the crossing angle of the second cable 19 in the drawn condition. In some embodiments, a longitudinal axis of the channel 51 is oriented to match an average crossing angle of the second cable 19 in the brace and drawn conditions. In some embodiments, a width of the channel 59 increases at the ends to allow for a change in the crossing angle of the second cable 19.

In some embodiments, a depth of the channel 51 increases at the ends of the channel 51. In some embodiments, a surface of the channel 51 that contacts the second cable 19 (e.g. a top surface as shown in FIG. 2) is curved, which helps to distribute the lateral forces applied between the second cable 19 and the channel 51.

In some embodiments, the second cable positioner 50 comprises a guide member 56 arranged to guide and/or be moved by the second cable 19. In some embodiments, the guide member 56 comprises the channel 51. Desirably, the guide member 56 is moveable with respect to the body 30. In some embodiments, the guide member 56 is arranged to slide within a slot or aperture 42 in the body 30. In some embodiments, the guide member 56 is arranged to traverse along a linear axis (not illustrated) with respect to the body 30. In some embodiments, the linear axis is parallel to the shooting axis 34. In some embodiments, the linear axis is orthogonal to a longitudinal axis of the channel 51. In some embodiments, the body 30 and the guide member 56 comprise complimentary engagement features that prevent movement in one or more orthogonal directions. For example, the body 30 can comprise a ridge and the guide member 56 can comprise a groove that receives the ridge. The guide member 56 can traverse along the ridge with respect to the body 30. In some embodiments, forces applied to the guide member 56 by the second cable 19 hold the guide member 56 against the body 30. In some embodiments, upper and lower surfaces of the body 30 (e.g. inner surfaces of the slot or aperture 42) are positioned to sandwich the guide member 56.

In some embodiments, a first channel 49 is oriented at a predetermined angle to the shooting axis 34, and a second channel 51 is oriented at an equal but opposite angle to the shooting axis 34.

In some embodiments, a first guide member 36 is similar in size and shape to a second guide member 56, but the two guide members 36, 56 have different orientations. In some embodiments, a first guide member 36 is flipped 180 degrees with respect to a second guide member 56.

Cable positioners 48, 50 can be made from any suitable material, such as materials traditionally used in cable positioners or cable guards in compound bows. In some embodiments, at least a portion of a cable positioner 48, 50 comprises metal. In some embodiments, at least a portion of a cable positioner 48, 50 comprises a polymer. Guide members 36, 56 can be formed of any suitable material. In some embodiments, a guide member 36, 56 comprises a polymer. In some embodiments, a guide member 36, 56 comprises a thermoplastic or a thermoset polymer. In some embodiments, a guide member 36, 56 comprises a lubricious polymer. In some embodiments, a guide member 36, 56 comprises a low friction material such as polyoxymethylene (POM) and/or polytetrafluoroethylene (PTFE). In some embodiments, a guide member 36, 56 comprises Delrin® acetal resin or Delrin® AF acetal resin available from E. I. du Pont de Nemours and Company.

Figure 3:
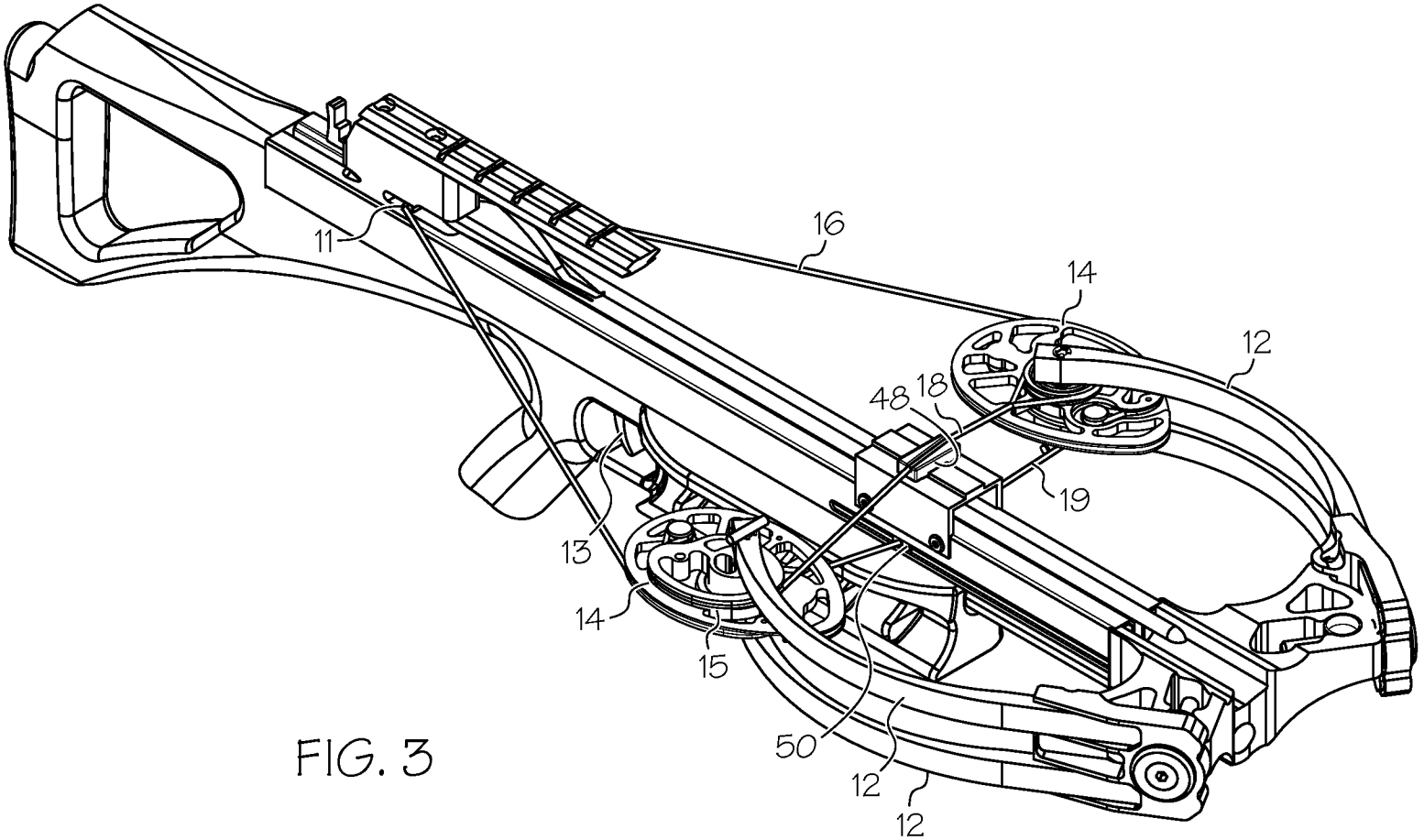
FIG. 3 shows the crossbow of FIG. 1 in a drawn orientation.

FIG. 3 shows an embodiment of a crossbow 10 in a drawn condition. In general, a latch 11 will hold the bowstring 16 and retain the crossbow 10 in a drawn condition. Actuation of a trigger 13 will release the bowstring 16.

In some embodiments, drawing the bowstring 16 causes the rotatable members to rotate, wherein at least one of the first or second cable 18, 19 will be taken up on a cam track 15. The cable 18, 19 take-up causes the limbs 12 to flex, storing energy.

During a draw cycle, one or more ends of each cable 18, 19 can change position. In some embodiments, the first and second cable positioners 48, 50 change their shape and/or positioning to accommodate movement of the cables 18, 19. For example, in some embodiments, guide members 36, 56 can be moved by the cables 18, 19.

Figure 4:
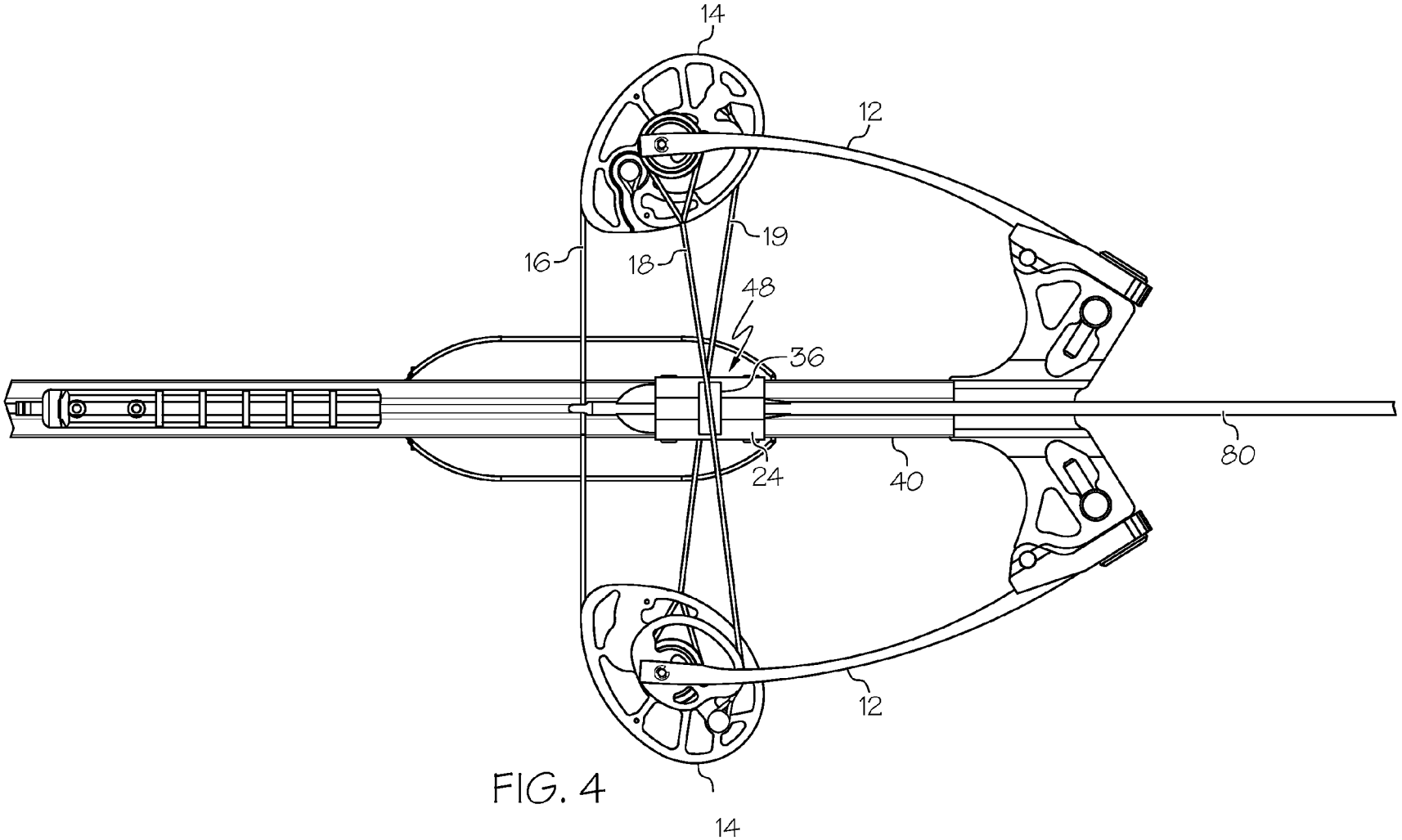
FIG. 4 shows a top view of an embodiment of a crossbow in a brace orientation.
Figure 5:
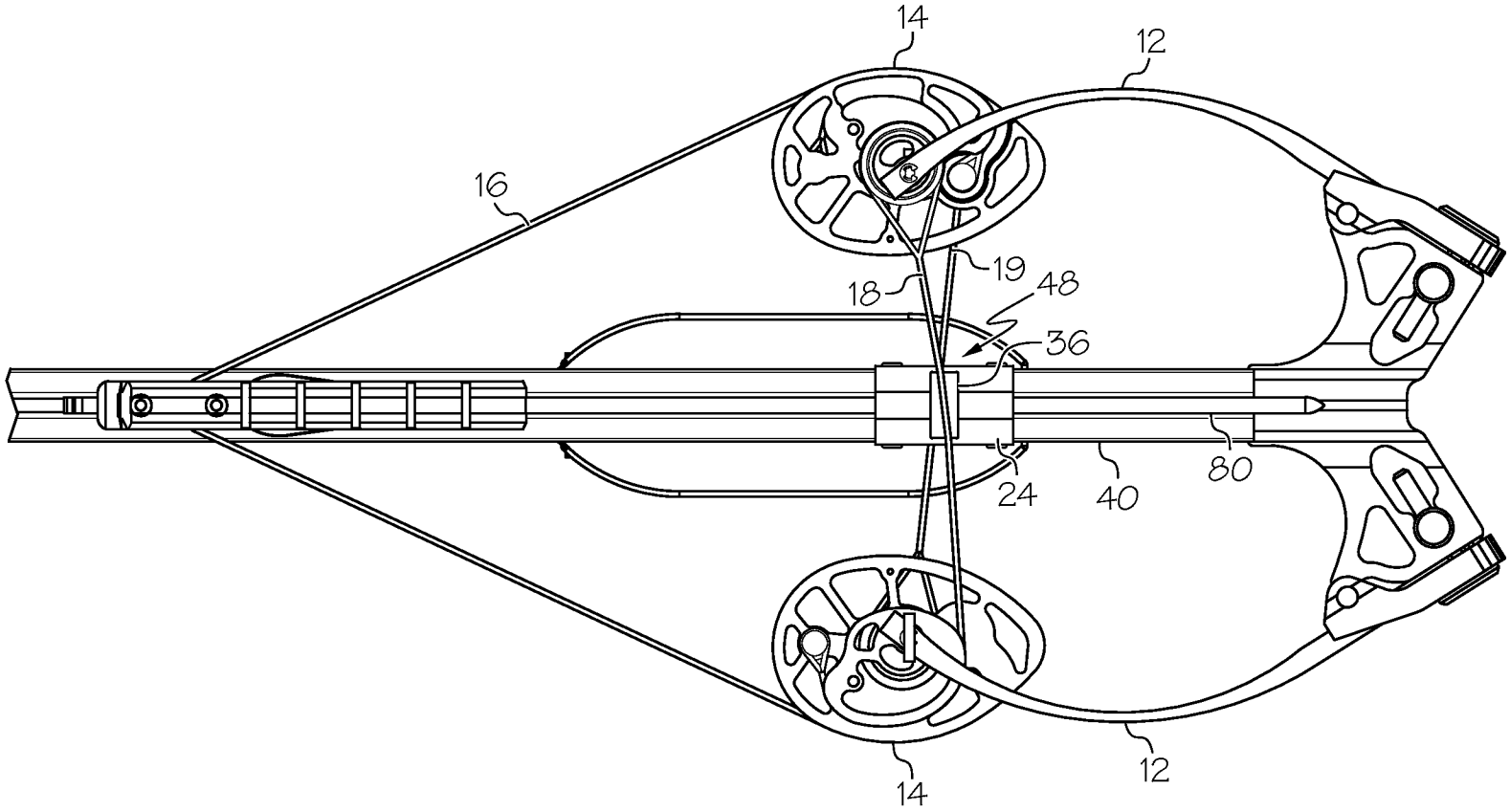
FIG. 5 shows a top view of the crossbow of FIG. 4 in a drawn orientation.

FIGS. 4 and 5 show top views of an embodiment of a crossbow 10. FIG. 4 shows a brace condition and FIG. 5 shows a drawn condition.

Figure 6:
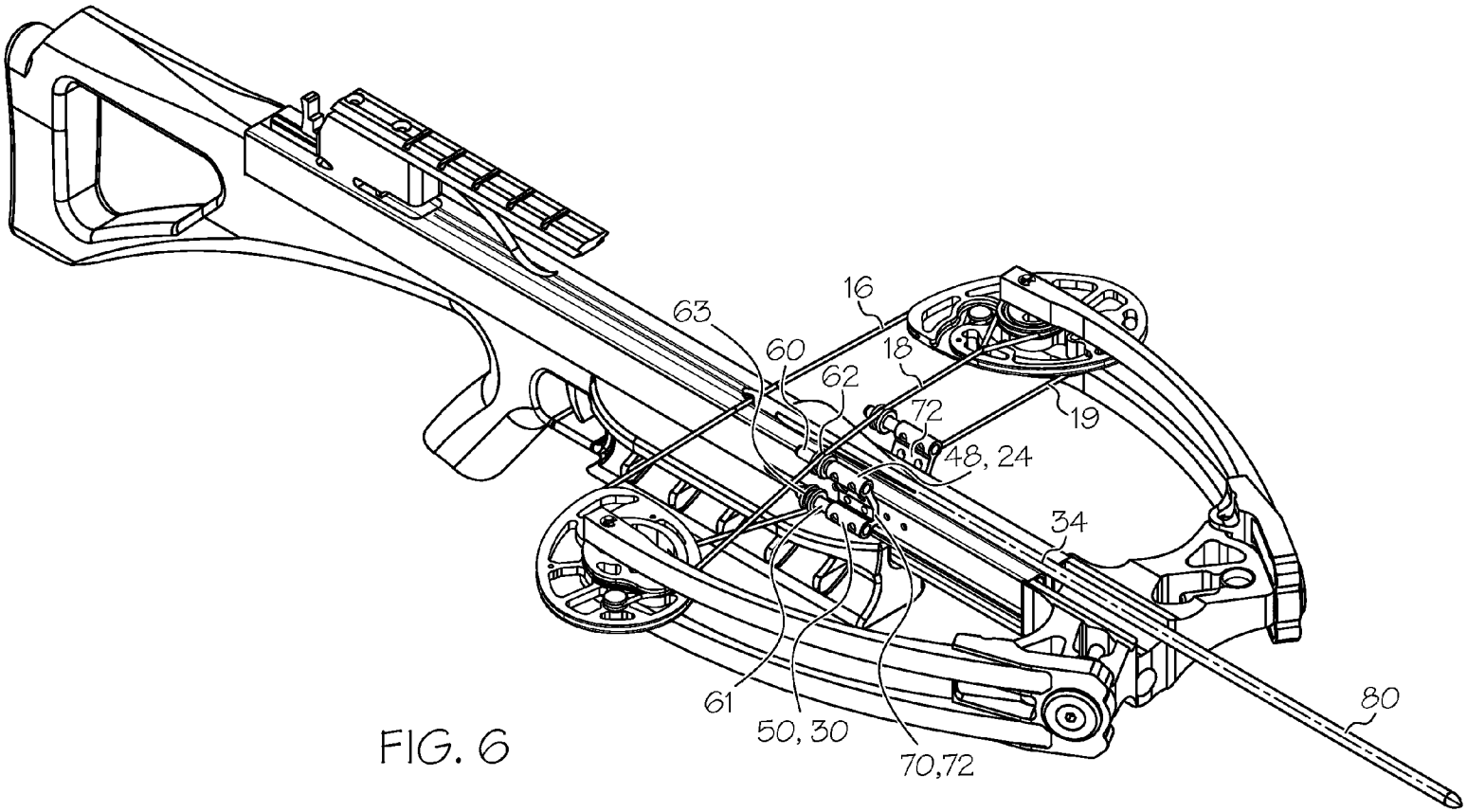
FIG. 6 shows another embodiment of a crossbow.
Figure 8:
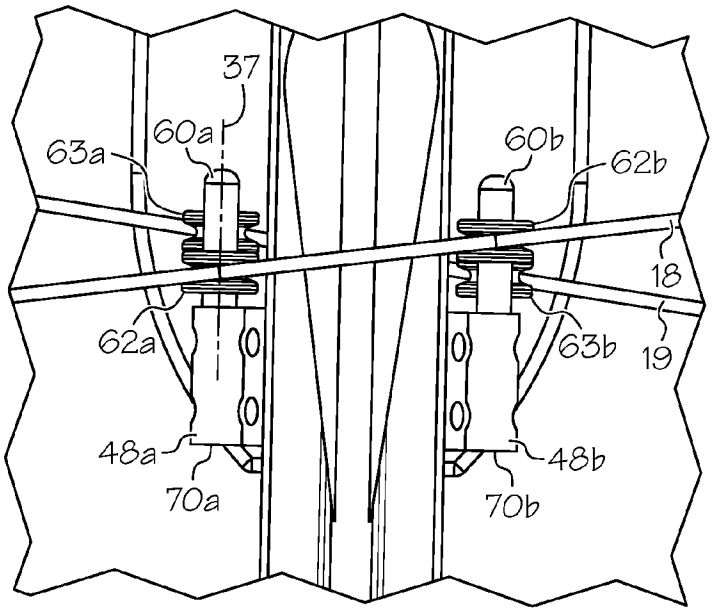
FIG. 8 shows a top view of the cable positioning members of FIGS. 6 and 7.
Figure 7:
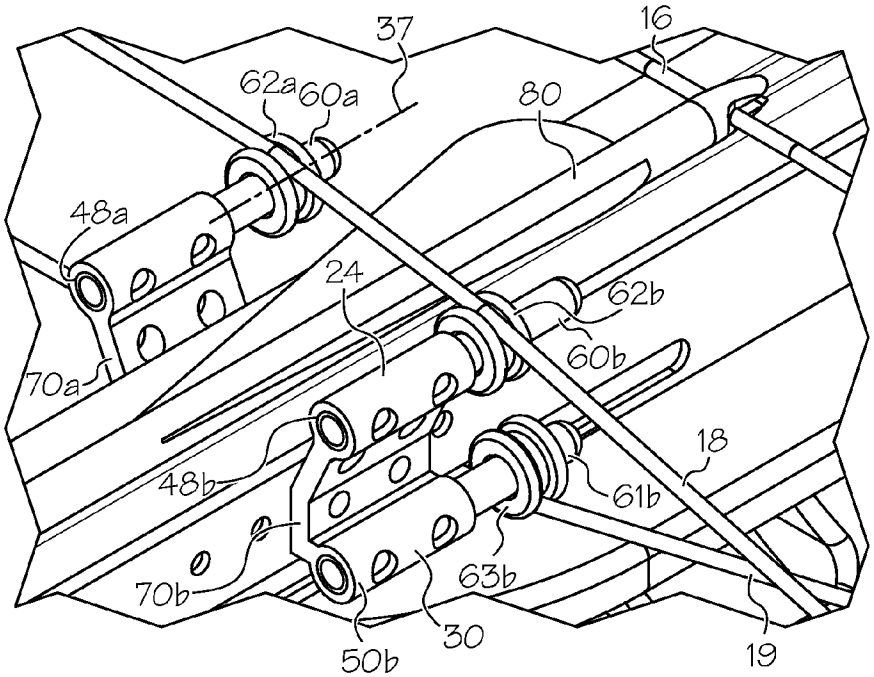
FIG. 7 shows another view of the cable positioning members shown in FIG. 6.

FIG. 6 shows an embodiment of a crossbow 10 comprising an embodiment of a first cable positioner 48 and an embodiment of a second cable positioner 50. FIGS. 7 and 8 show the embodiment of FIG. 6 in greater detail.

In some embodiments, a crossbow 10 comprises a cable guard 70 that comprises a first cable positioner 48 and a second cable positioner 50. In some embodiments, a cable guard 70 comprises a body 72 that is attachable to the crossbow 10.

In some embodiments, a crossbow 10 comprises a first cable guard 70*a* comprising a first cable positioner 48*a* and a second cable positioner 50*a*, and a second cable guard 70*b* comprising a first cable positioner 48*b* and a second cable positioner 50*b*. In some embodiments, the first cable guard 70*a* and the second cable guard 70*b* are attached to opposing portions of the stock 40 (e.g. opposing sides). In some embodiments, the structure of a second cable guard 70*b* comprises a mirror image of the structure of a first cable guard 70*a* taken across the shooting axis 34 (e.g. top view), although when the crossbow 10 is strung, the various cable positioners 48*a*, 48*b*, 50*a*, 50*b* may assume non-mirror image positions due to the locations of the cables 18, 19.

In some embodiments, a first and/or second cable positioner 48, 50 comprises a body 24, 30 comprising a shaft 60, 61. In some embodiments, a first and/or second cable positioner 48, 50 comprises a roller 62, 63. Desirably, a roller 62, 63 is arranged to rotate with respect to the body 24, 30, for example rotating as a cable 18, 19 in contact with the roller 62, 63 moves (e.g. causing the rotation). In some embodiments, a roller 62, 63 comprises a sheave having a circumferential track for receiving a cable 18, 19.

In some embodiments, a guide member 36, 56 comprises a roller 62, 63, and the roller 62, 63 is arranged to traverse with respect to the body 24, 30. In some embodiments, roller 62, 63 moves with respect to the body 24, 30 along an axis 37. In some embodiments, the axis 37 comprises a central axis of a shaft 60, 61. Thus, in some embodiments, a roller 62, 63 is arranged to rotate about axis 37 and traverse along axis 37.

A shaft 60, 61 can be made from any suitable material. In some embodiments, a shaft 60, 61 comprises metal. In some embodiments, a shaft 60, 61 comprises carbon.

A roller 62, 63 can be made from any suitable material. In some embodiments, a roller 62, 63 comprises metal. In some embodiments, a roller 62, 63 comprises carbon. In some embodiments, a roller 62, 63 comprises a polymer. In some embodiments, a roller 62, 63 comprises a lubricious polymer. In some embodiments, a roller 62, 63 comprises a low friction material such as PTFE. In some embodiments, a roller 62, 63 comprises a first material arranged to contact a cable 18, 19 and a second material arranged to contact the body 24, 30 of the cable positioner 38, 50. For example, a roller 62, 63 can comprise a body formed mainly of the first material, and a sleeve or bearing made from a second material. The first material can be selected for good strength and abrasion resistance characteristics, and the second material can be selected to provide high lubricity and/or low friction.

Figure 9:
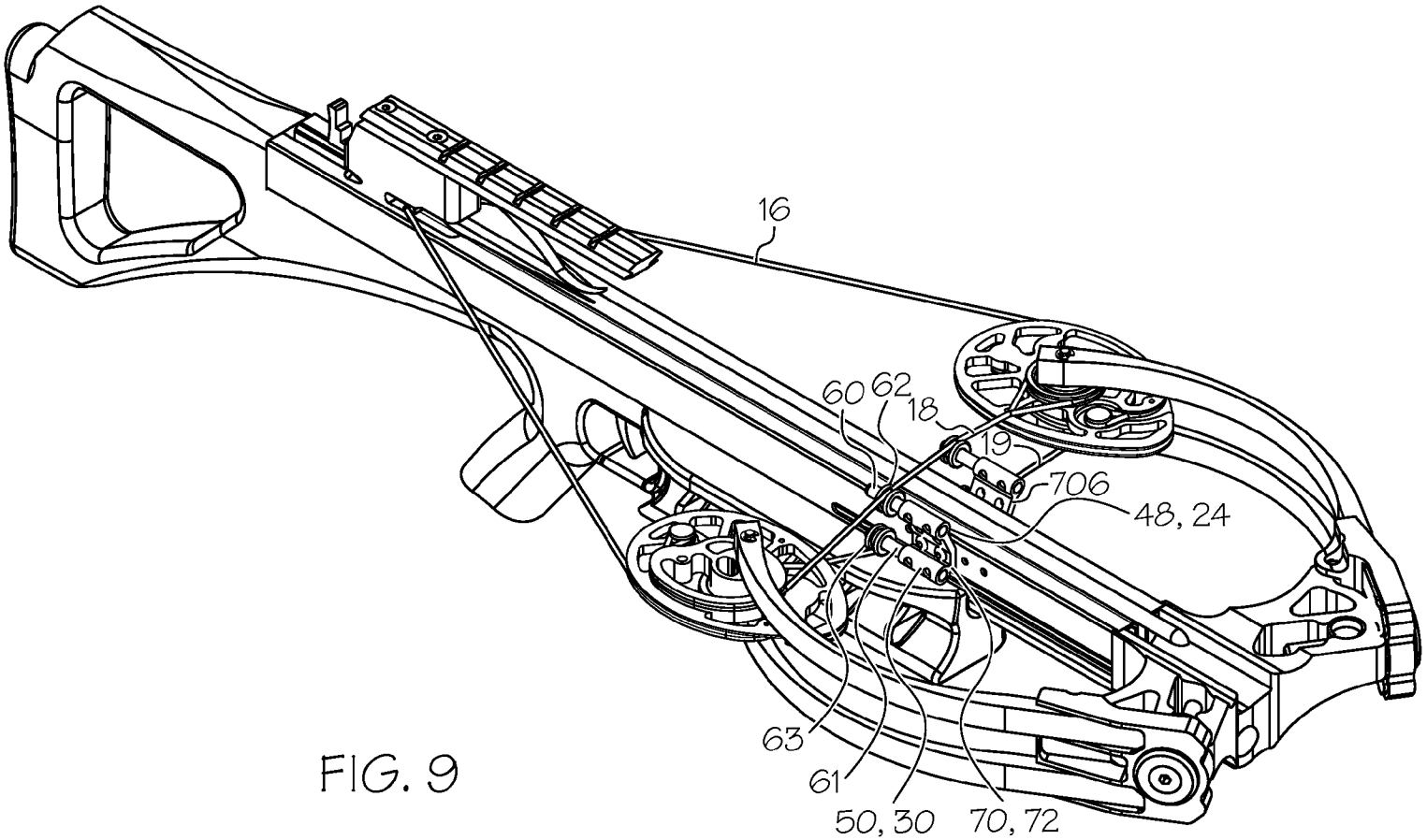
FIG. 9 shows the crossbow of FIG. 6 in a drawn orientation.

FIG. 9 shows the crossbow 10 of FIG. 6 in a drawn orientation. As the crossbow 10 is drawn, one or more ends of each cable 18, 19 can change position. In some embodiments, the cables 18, 19 cause rollers 62, 63 to rotate as the crossbow 10 is drawn. In some embodiments, the cables 18, 19 cause rollers 62, 63 to move with respect to the cable positioner body 24, 30 as the crossbow 10 is drawn.

Figure 10:
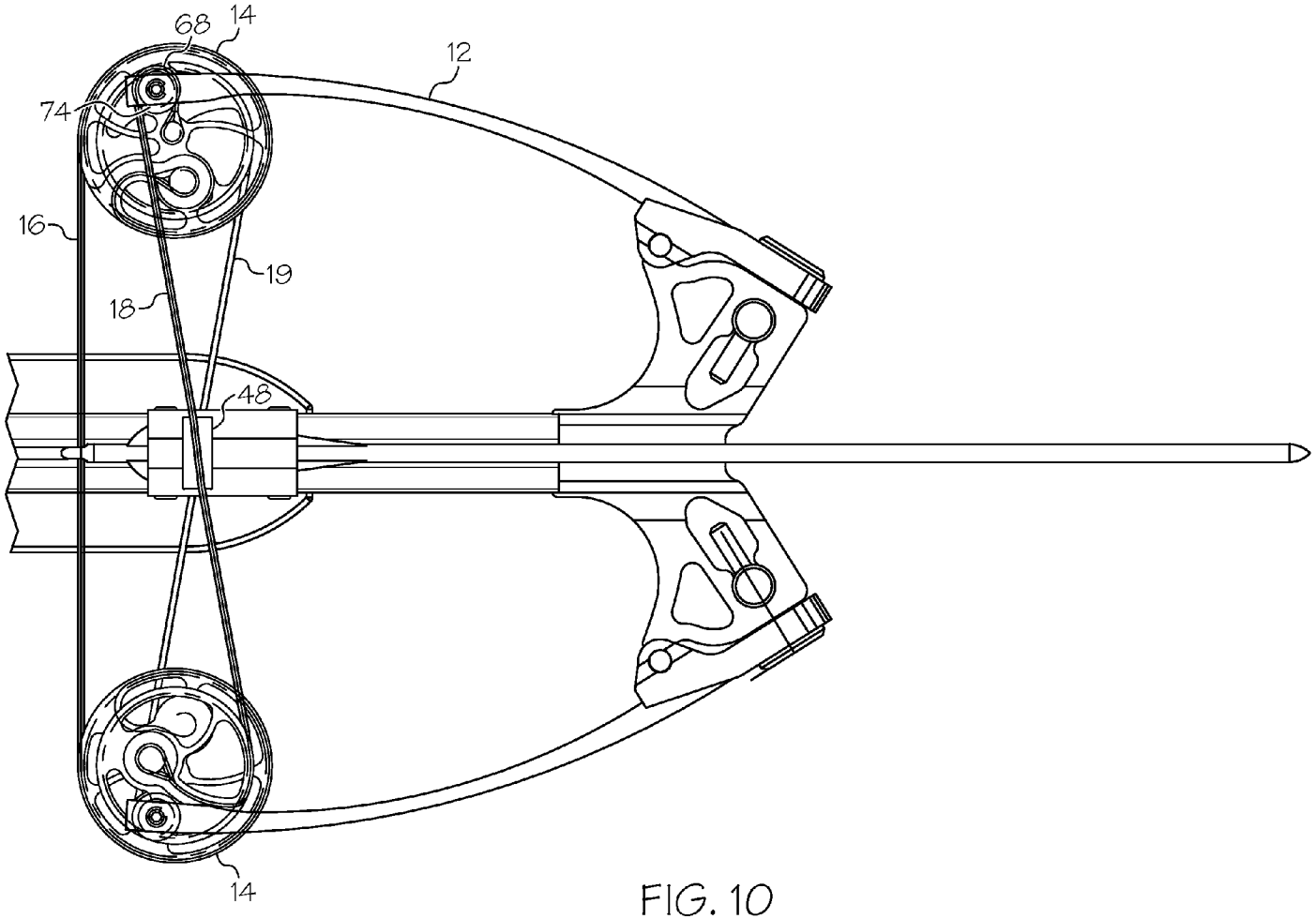
FIG. 10 shows another embodiment of a crossbow in a brace orientation.
Figure 11:
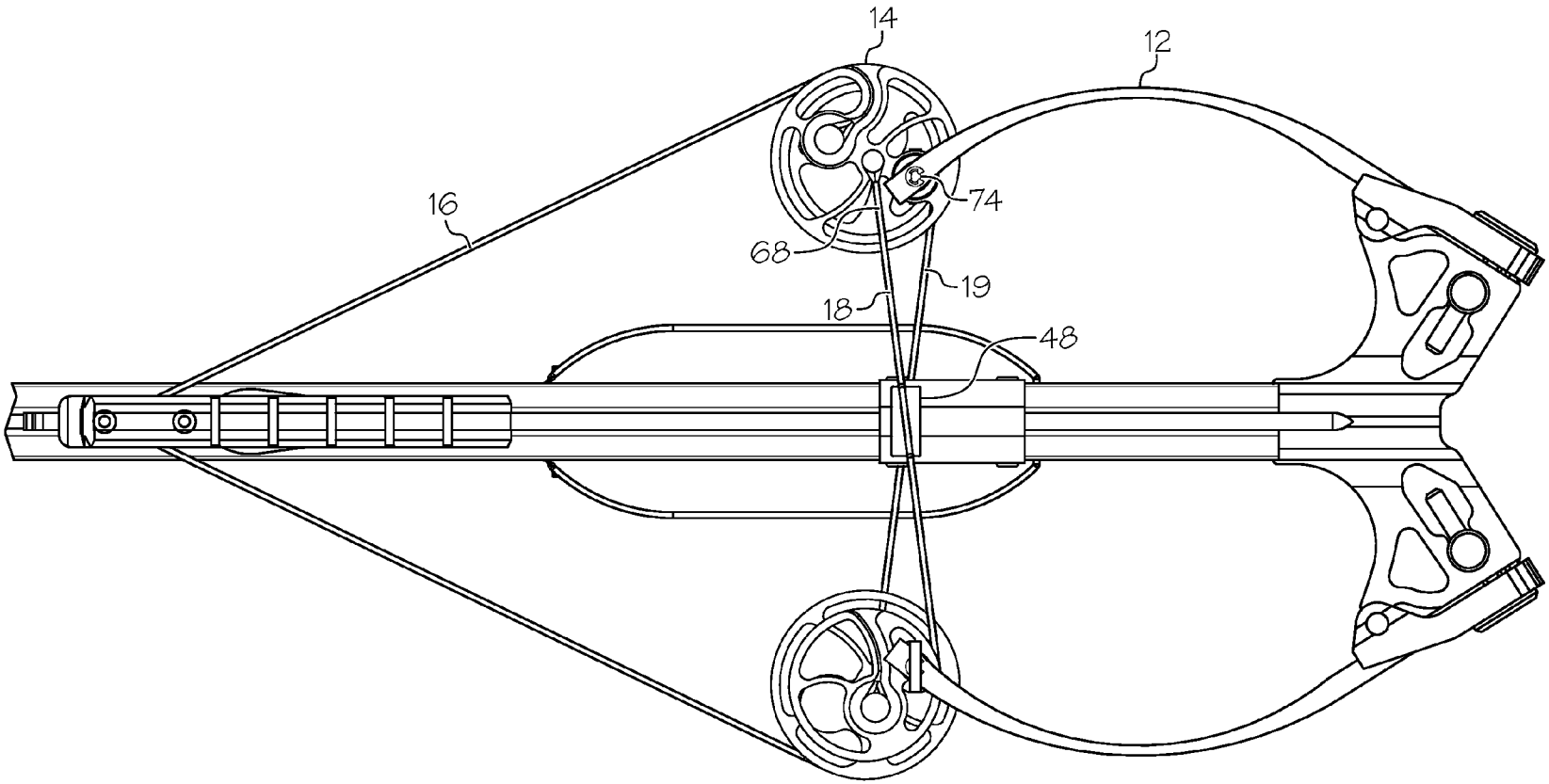
FIG. 11 shows the crossbow of FIG. 10 in a drawn orientation.

FIG. 10 shows another embodiment of a crossbow 10 in a brace condition, and FIG. 11 shows the crossbow 10 in a drawn condition.

The crossbow 10 shown in FIGS. 10 and 11 has rotatable members 14 that are different from, for example, the rotatable members 14 shown in FIG. 1.

In some embodiments, a cable 18, 19 comprises an end portion 68 that is arranged to feed out from the rotatable member 14 during at least a portion of a draw cycle. In some embodiments, an end portion 68 is arranged to unspool from the rotatable member 14 during at least a portion of a draw cycle. In some embodiments, an end portion 68 wraps around at least a portion of a spool member 74 in the brace condition. In some embodiments, the end portion 68 does not contact the spool member 74 in the drawn condition.

In some embodiments, the bow portion 20 comprises another suitable compound bow configuration, such as a single-cam, 1.5/hybrid/CPS cam, binary cam or any other suitable configuration. In some embodiments, either the first cable 18 or the second cable 19 comprises a control cable or secondary feed out cable.

In some embodiments, the bow portion 20 comprises cables 18, 19 and rotatable members 14 as described in U.S. Pat. No. 6,990,970.

In some embodiments, a crossbow 10 comprises one or more force vectoring cable anchors, for example as described in U.S. Pat. No. 8,020,544.

In some embodiments, a crossbow 10 comprises one or more limb retaining assemblies, for example as described in U.S. patent application Ser. No. 12/916,261.

U.S. Patent Application Nos. 61/699,271, 61/699,244, 61/699,197, 61/699,248 and Ser. No. 12/916,261 are hereby incorporated herein by reference in their entireties. U.S. Pat. Nos. 6,990,970 and 8,020,544 are hereby incorporated herein by reference in their entireties.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock, a first limb, a first rotatable member, a second limb and a second rotatable member;

a bowstring extending between the first rotatable member and the second rotatable member;

a first cable extending between the first rotatable member and the second rotatable member and a second cable extending between the first rotatable member and the second rotatable member;

a first cable positioner attached to said stock;

wherein the crossbow defines a shooting axis, the first cable is offset from the shooting axis in a first direction and the second cable is offset from the shooting axis in a second direction different from the first direction, said first cable positioner biasing the first cable away from said stock, at least a portion of said first cable positioner moveable with respect to said stock.

2. The crossbow of claim 1, wherein the first cable is positioned above the shooting axis and the second cable is positioned below the shooting axis.

3. The crossbow of claim 1, said first cable positioner comprising a channel, said first cable positioned in said channel.

4. The crossbow of claim 1, wherein said first cable positioner comprises a body portion supported by said stock and a guide member arranged to move with respect to the body portion, said guide member contacting said first cable.

5. The crossbow of claim 4, wherein said guide member is moveable along a guide member axis, said guide member axis being parallel to said shooting axis.

6. The crossbow of claim 1, comprising a second cable positioner arranged to position said second cable.

7. The crossbow of claim 6, wherein said second cable positioner comprises an aperture in said stock.

8. The crossbow of claim 6, wherein said second cable positioner comprises a guide member arranged to move with respect to said stock.

9. The crossbow of claim 8, wherein said guide member comprises a channel, said second cable positioned in said channel.

10. The crossbow of claim 1, wherein said first cable positioner comprises a body defining a tunnel, said shooting axis oriented in said tunnel.

11. The crossbow of claim 1, wherein said first cable positioner comprises a roller.

12. The crossbow of claim 11, wherein said roller is arranged to rotate about a central axis and traverse along said central axis.

13. The crossbow of claim 11, comprising a second cable positioner arranged to position said second cable, said second cable positioner comprising a roller.

14. The crossbow of claim 1, comprising a cable guard attached to said stock, said cable guard comprising a first cable positioner and a second cable positioner, said first cable positioner arranged to bias said first cable away from said shooting axis and said second cable positioner arranged to bias said second cable away from said shooting axis.

15. The crossbow of claim 14, comprising a second cable guard arranged to position said first cable and said second cable.

16. The crossbow of claim 15, wherein said first cable guard and said second cable guard are located on opposite sides of said shooting axis.

17. The crossbow of claim 10, said body comprising a ridge, said first cable positioner further comprising a guide member moveable with respect to said body along said ridge, said guide member contacting said first cable.

18. A crossbow comprising:

a stock, a first limb, a first rotatable member, a second limb and a second rotatable member;

a bowstring extending between the first rotatable member and the second rotatable member;

a first cable and a second cable extending between the first rotatable member and the second rotatable member;

a cable positioner attached to said stock;

wherein the crossbow defines a shooting axis, said stock extending below said shooting axis, the first cable positioned above said shooting axis, the second cable positioned below said shooting axis, said cable positioner biasing said first cable away from said shooting axis, at least a portion of said cable positioner moveable with respect to said stock.

19. The crossbow of claim 18, said cable positioner comprising a body attached to said stock and a guide member in contact with said first cable, said guide member moveable with respect to said body.

20. The crossbow of claim 19, said guide member moveable with respect to said body along a linear axis.

* * * * *